United States Patent [19]

Hipp

[11] 4,245,403

[45] Jan. 20, 1981

[54] APPARATUS FOR DISPLAYING THE DETONATING, LIGHT FLASH AND SMOKE DEVELOPMENT OF AMMUNITION

[76] Inventor: Jan Hipp, SchulteBdamm 57, 2000 Hamburg 64, Fed. Rep. of Germany

[21] Appl. No.: 5,027

[22] Filed: Jan. 19, 1979

[30] Foreign Application Priority Data

Jan. 20, 1978 [DE] Fed. Rep. of Germany ..... 2802478

[51] Int. Cl.[3] ..... G09B 9/00

[52] U.S. Cl. ..... 434/11; 102/37.2; 102/37.7; 272/20; 272/14

[58] Field of Search ..... 35/25; 272/8 F, 14, 272/20; 102/31, 34.5, 37.2, 37.3, 37.4, 37.7

[56] References Cited

U.S. PATENT DOCUMENTS

| | | | |
|---|---|---|---|
| 1,583,237 | 5/1926 | Parsons | 35/25 |
| 1,613,852 | 1/1927 | Shunk | 102/37.4 |
| 3,238,642 | 3/1966 | Ohlund | 272/14 X |
| 3,334,425 | 8/1967 | Ohlund | 35/25 |

*Primary Examiner*—William H. Grieb

*Attorney, Agent, or Firm*—Arnold, White & Durkee

[57] ABSTRACT

An apparatus for simulating the detonation, light flash and smoke development of ammunition, without the actual firing or impact of the real thing, is disclosed. A plurality of smoke and flash pyrotechnic charges contained in a replaceable support panel, each charge having its own detonator, simulates the smoke and flash of the ammunition. In addition to the smoke and flash simulation, means for generating a noise impulse is provided to simulate the detonation. A control unit, responsive to a firing command, controls the generation of the smoke, flash and detonation noise to simulate either the firing or the impact of the ammunition. The apparatus is adaptable for mounting on the gun barrel of an armored vehicle to give the crew as real a simulation as possible.

13 Claims, 3 Drawing Figures

Fig.1
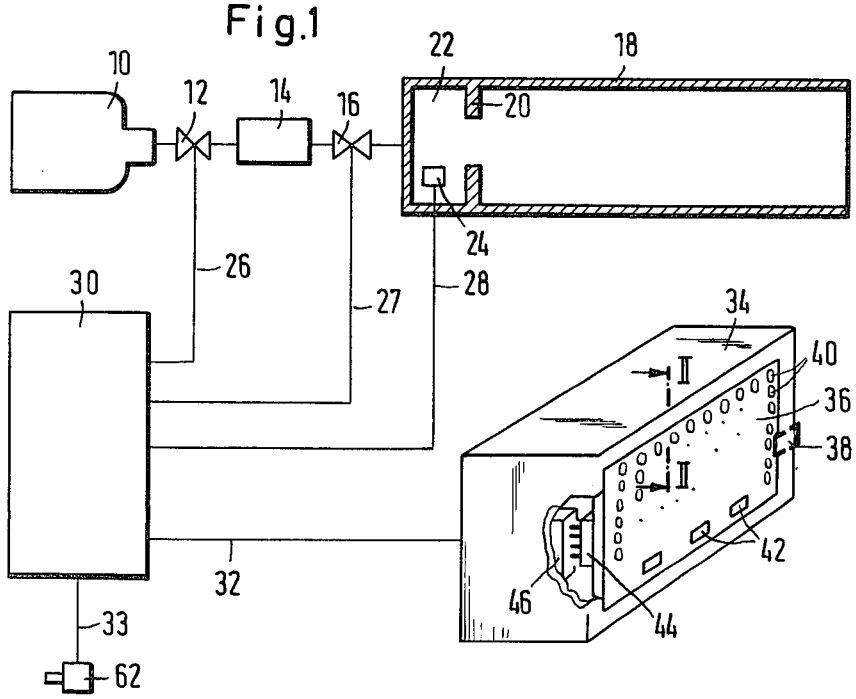
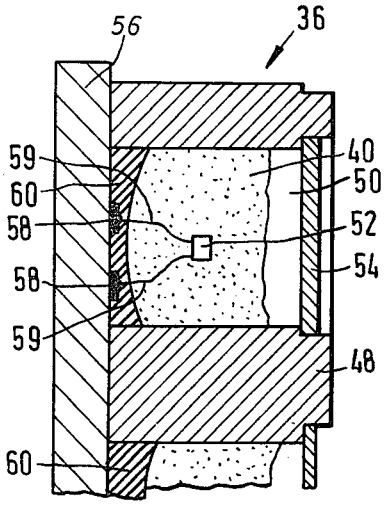
Fig.2
Fig.3
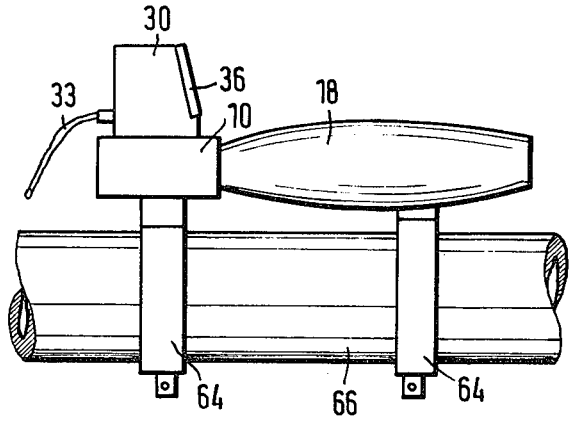

APPARATUS FOR DISPLAYING THE DETONATING, LIGHT FLASH AND SMOKE DEVELOPMENT OF AMMUNITION

BACKGROUND OF THE INVENTION

This invention relates to ammunition firing simulators. More particularly, to a device for displaying the detonation, light flash and smoke development of ammunition in the absence of actual firings of the real thing.

In military maneuvers, it is not possible to fire live ammunition. Typically, shots "fired" by one participant at another are allocated to the participants by the maneuver director, or are simulated by shooting simulation devices, such as a laser shooting-simulator. Since live ammunition firings are forbidden, it is desirable to provide a device which displays the detonation, light flash and smoke development of a genuine shot from the firing weapon as a replacement for the real thing. By providing such a device, the maneuver can be realistically rendered, and the participants can become accustomed to conditions which occur when shooting, or being shot at, with live ammunition. More particularly, the device willl enable the maneuver participants to determine the "shot" direction or by whom the "shot" was fired.

In the prior art devices, the detonation, flash and smoke development is produced by igniting a single pyrotechnic explosive charge which is constructed in the manner of a saluting cannon. A relatively strong and large cannon set is required in order to generate a sufficiently powerful detonation. This calls for a relatively large amount of space, for example, approximately 10 cm diameter and 15 cm length. Additionally, it involves a very large danger zone, for example, 50 m to the front and 10 m to the side. Within this danger zone, unprotected persons, such as the crew of the weapon or armored vehicle equipped with the device, are subject to a considerable risk of injury.

Further disadvantages of known prior-art devices are due to the fact that because of the space requirements, only a few "shots", for example eight, can be stored in the device. Also, the weight of the shots are excessive, and when mounted on a gun barrel, can influence the rapidity and accuracy of the gun's laying movements. Additionally, the material costs for the individual "shots" are relatively high, and there is no means to individually vary the detonation, flash or smoke development in order to accurately represent different kinds of ammunition.

The object of the invention is to provide a device for displaying the detonation, flash and smoke development for ammunition in which a large number of "shots" can be displayed with low cost and space requirements, and with the least possible danger to persons nearby.

SUMMARY OF THE INVENTION

In accordance with this invention, a plurality of pyrotechnic charges, together with their respective detonators, are arranged on a common carrier, the charges providing the flash and/or smoke development simulation. The carrier is provided with or is connectable to a control unit. The carrier can be made from a low price material as a disposable unit with connection leads, preferably printed circuit leads, extending to the detonators of the individual pyrotechnic charges. In this manner, the carrier can be exchangeably inserted into the control unit, with the control unit comprising the means for selectively controlling the individual pyrotechnic charges.

Associated with the pyrotechnic charges is a device for generating a detonation noise impulse. This device is operable simultaneously with the ignition of a pyrotechnic charge. According to the preferred embodiment of the invention, the detonation noise impulse is generated by means other than pyrotechnic means. Namely, by igniting an explosive air-gas mixture whose mix is controlled by the actuation of controllable valves. The air-gas mixture is ignited in an explosion chamber of optimum construction to generate the intensity, tone and propagation direction of the desired explosive detonation.

BRIEF DESCRIPTION OF THE DRAWINGS

For a fuller understanding of the nature and objects of the invention, reference should be had to the following detailed description taken in connection with the accompanying drawings, in which:

FIG. 1 shows a diagrammatic functional view of the entire device,

FIG. 2 shows an enlarged section of a detail along the line II—II of FIG. 1,

FIG. 3 is a side view of the device mounted on a weapon.

Similar reference characters refer to similar parts throughout the several views of the drawings.

DETAILED DESCRIPTION OF THE PREFERRED EMBODIMENTS

Turning now to the drawings and first to FIG. 1, the number 10 in FIG. 1 refers to a storage vessel containing a combustible gas, for example propane, under pressure. This can be a conventional gas cylinder for the operation of camping cookers or the like. The storage container 10 is connected through a controllable solenoid valve 12 to an intermediate vessel 14 that in turn is connected, via a further controllable solenoid valve 16, to a tube 18. Tube 18 is open at one end with the opposite end (inlet) partitioned by means of a constriction or restrictor 20 to form an explosion or detonating chamber 22 in which a high voltage firing device 24 is disposed. The solenoid valves, 12 and 16, and the firing device 24 are respectively connected by means of conductors 26, 27 and 28 to a control unit 30. Also, the solenoid valve 12 can be constructed as a pressure-reducing valve so that the gas enters the intermediate vessel 14 at a pressure which is lower than the pressure in the storage container 10, but is still higher than atmospheric pressure.

FIG. 1 shows the control unit 30 connected by means of a cable 32 to the flash and smoke generator unit 34. A plate-shaped support 36 is inserted into the front of the generator unit 34, and is retained therein by means of clips 38. The support 36 contains a plurality of pyrotechnic illumination and smoke sets 40, in matrix configuration, disposed in corresponding chambers of the support 36. The support 36 can, for example, have one hundred such illumination and smoke sets 40, as well as, one or more smoke sets 42. These smoke sets 42, in contrast of the illumination and smoke sets 40, simulate the impact of a shot, i.e. a hit, instead of the firing of a shot. Because the pyrotechnic charges provide only light flashes and/or smoke development, the charges can be made very small and harmless to its surroundings.

The support 36 also has all the electric leads of the detonators of the individual illumination and smoke sets 40 or 42 combined into a connector 44. Connector 44 is inserted into a corresponding plug 46 when the support 36 is inserted into the container 34 so that all of the detonators are electrically connected to control unit 30. This permits the control unit 30 to selectively or sequentially detonate the pyrotechnic charges.

Turning now to FIG. 2, the construction of a portion of the support panel 36 is shown in detail. Support 36 comprises a front panel 48 of a suitable resistant material such as aluminum, plastics or ceramics with openings 50 in matrix configuration, each opening accommodating an illumination and smoke set 40 with an associated detonator 52. The material used to form front panel 48 must be of sufficient structural strength so that the detonation of one of the illumination or smoke sets 40 or 42 will not detonate adjacent charges. Each opening 50 is closed by a lid 54.

The support 36 also comprises a contiguous rear panel 58 constructed in the manner of a printed circuit board, i.e. constructed of electrically insulating material and carrying printed circuit tracks 58 to which the connecting wires 59 of the detonators 52 are soldered. The panels 48 and 56 can be joined to each other in suitable manner, for example, by gluing. The joining of panels 48 and 58 define the cavities into which the pyrotechnic charges are placed. To provide additional sealing, the bottoms of the cavities 50 can be filled with a sealing compound 60 which covers the conductor tracks 58. This sealing compound 60 is used to further achieve the requirements expressed above—the cavities produced by the joined panels 48 and 56 must not permit adjacent smoke and illumination sets to be fired when an individual charge is detonated. Support 36, with illumination and smoke sets 40 and 42, can be interchangeably inserted into the container 34 and can be produced simply and inexpensively by mass production methods.

The support 36 is constructed as follows: The primers 52 with their connecting wires 59 are first soldered on the panel 56 containing the conductor tracks 58 and the plug connector 44. The panel 48 is then adhesively mounted on the panel 56 so that the primers 52 are disposed in the openings 50 which are still empty. The sealing compound 60 is then introduced and allowed to harden. Subsequently measured quantities of pyrotechnic illumination and smoke mixture 40 is introduced into the chambers 50 and closed by the lids 54. This results in the production of a lightweight and inexpensive carrier with a plurality of "shots", each shot represented by a light flash and/or smoke development. When all the shots have been spent, the carrier 36 can be simply replaced in the container 34 with a fresh one.

The control unit 30 is connected through a conductor 33 to a release key 62, which can be the trigger of the weapon to which the apparatus according to the invention is attached.

The device described above operates as follows: When the device is taken into operation, i.e. when the control unit 30 is switched on, the valve 12 is opened and a measured quantity of gas is admitted into the intermediate vessel 14. Valve 12 is then closed. The device is now ready for firing. Operation of the release key 62 opens the solenoid valve 16 so that the preselected quantity of gas contained in the intermediate vessel 14 flows into the chamber 22. There, the gas mixes with air. After a slight delay of approximately 1/10 sec., a high-voltage discharge is produced on the firing apparatus 24 so that the gas-air mixture in the chamber 22 is ignited. The explosion and the corresponding propagation of the reaction front along the tube 18 produces a noise impulse which propagates in a direction toward the open end of the tube 18.

Together with the control pulse delivered to the firing device 24, the control unit 30 also transmits a control pulse via the conductor 32, plug-connector 46, 44 and the conductors 58 to the illumination and smoke sets 40 selected at that time. This pulse causes the latter to ignite with the resulting explosive pressure causing the light-weight lid 54 to be blown away. The exploding illumination and smoke set then discharges forwardly from the support 36 in the form of an incandescent cloud accompanied by smoke development. By separating the functions of detonation, and flash and smoke development, it is possible to optimize each of the two devices in respect to its function so that one device can generate a harmless detonation noise in rapid succession, while the other device can generate a large number of harmless light flashes and smoke developments.

When the impact of a hit instead of the firing of a shot is to be simulated, one of the smoke sets 42 instead of one of the illumination and smoke sets 40 will be ignited by the control unit 30 to indicate a hit, for example, by emitting an orange-colored smoke cloud.

After each ignition of the gas mixture in the chamber 22, the control unit 30 automatically opens the solenoid valve 12 to again admit the preselected quantity of gas into the intermediate vessel 14 so that the device is immediately ready for the next detonation "shot".

The intensity and tone of the detonation produced by the amount of gas kept in readiness in the intermediate vessel 14 is varied by controlling the open time of the valve 12, by influencing the ignition time of the firing device 24, and by dimensioning and shaping tube 18 to resonate with the detonation. More particularly, the tube 18 can have a shape which deviates from the cylindrical shape according to FIG. 1. For example, tube 18 can be flared to the front or it can have a constriction at the open end. A bulged shape, which first expands from the chamber 22 and then constricts towards the open end of the tube 18 is especially advantageous for producing a realistic ammunition sound.

Turning now to FIG. 3, one embodiment of the present invention is shown mounted to the barrel of an armored vehicle's gun. As illustrated in FIG. 3, the entire device, namely the gas storage vessel 10 (the intermediate vessel 14 and explosion chamber 22 not shown), the control unit 30, and the support 36 containing the flash and smoke sets, all combined into one structural unit, can be mounted by means of pipe saddles 64 onto the barrel 66 of an armored vehicle's gun. A cable 33 extends from the control unit 30 to the release key 62 disposed in the interior of the armored vehicle (not shown in FIG. 3). As previously mentioned, the release key 62 produces a firing command to the control unit 30.

A pyrotechnic composition forming the least possible gas pressure and oxide, and suitable for developing smoke is preferred for the illumination and smoke sets 40. Suitable compositions and pyrotechnic sets are based on heavy-metal oxide or peroxide and metal powders, for example, zirconium, titanium or light alloys. The composition used to develop intensive orange-colored smoke within 1 to 2 seconds, after ignition, and having a duration of approximately 5 to 6 seconds may comprise a granulate. Advantageously, the smoke set comprises an oxidation-stable aminoanthraquinone, for example 1-amino-2-methylanthraquinone and a chloratelactose calorific bed.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement or parts, for example, equivalent elements or materials may be substituted for those illustrated and described herein, parts may be reversed, and certain features of the invention may be utilized independently of the use of other features. By further example, the illumination-smoke sets 40 and the smoke sets 42 may be disposed in separate carrier plates, each of which is inserted in the container or frame 34. These and other changes would be apparent to one skilled in the art after having the benefit of this description of the invention.

What is claimed is:

1. An apparatus for simulating the light flash and smoke development of ammunition comprising:

(a) a support having arranged thereon a plurality of pyrotechnic charges, each said charge having a detonator, and a plurality of electrical connecting leads for supplying current for each detonator for selective firing of each charge;

(b) a control unit responsive to a firing command, for selectively igniting selected ones of said pyrotechnic charges; and (c) means for releasably connecting said support as a disposable magazine to said control unit, and for electrically connecting each said connecting lead to said control unit.

2. The apparatus in accordance with claim 1 wherein the support comprises:

(a) a base of electrically insulated material having disposed thereon printed electrical circuit paths connected to the electrical connection leads;

(b) a panel attached to said base, said panel having a plurality of through holes cut therein in a matrix arrangement, said base and said through holes defining chambers for holding said charges, said detonators connected to the circuit paths whereby each detonator can be individually selected by said control unit; and (c) sealing means for sealing said chambers and protecting said charges from contamination prior to firing.

3. The apparatus in accordance with claim 1 further comprising means responsive to said control unit for generating a detonation noise impulse.

4. The apparatus in accordance with claim 3 wherein said means for generating a detonation noise impulse comprises:

(a) a supply of combustible gas;

(b) an explosion barrel;

(c) means for metering a preselected quantity of said gas into said explosion barrel; and (d) an ignitor contained in said barrel and responsive to said control unit, for igniting said gas to produce the detonation noise impulse.

5. The apparatus in accordance with claim 4 wherein said explosion barrel comprises:

(a) a tube having an open end for permitting air to enter and mix with said gas;

(b) a combustion chamber containing said ignitor, said combustion chamber (1) is located opposite the open end of said barrel, and (2) receives said combustible gas and the air prior to ignition; and (c) a restrictor located between said combustion chamber and the open end of said barrel, said restrictor having a central opening through which the exploding air-gas mixture propagates, said tube shaped to boost and align the noise impulse generated by the exploding gas.

6. The apparatus in accordance with claim 4 wherein said metering means comprises a control valve responsive to said control unit for passing the preselected quantity of said combustible gas into said barrel.

7. The apparatus in accordance with claim 4 wherein said metering means comprises:

(a) an intermediate gas storage vessel, for storing the preselected quantity of combustible gas prior to each ignition; and (b) first and second control valves responsive to said control unit, (1) said first valve metering said gas from said supply to said storage vessel, and (2) said second valve metering said gas from said storage vessel to said barrel.

8. The apparatus in accordance with claim 7 wherein said first valve is a pressure-regulating valve, for regulating the pressure of said gas to said intermediate gas storage vessel, said regulated pressure is less than the pressure in said supply but greater than atmospheric pressure.

9. The apparatus in accordance with claim 5 wherein said barrel shape expands from said combustion chamber and again constricts at said open end.

10. The apparatus in accordance with claim 1 wherein a first portion of said plurality of pyrotechnic charges are provided for displaying the firing of ammunition and a second portion of said plurality of charges are provided for displaying the impact and/or explosion of ammunition.

11. The apparatus in accordance with claim 10 wherein the first and second portions of pyrotechnic charges consist of (1) flash charges that produce substantial light flashes with little or no smoke development, and (2) smoke charges that produce strong smoke development, respectively.

12. The apparatus in accordance with claim 9 wherein said control means controls the detonation of said pyrotechnic smoke and flash charges and said combustible gas in any combination thereof, said combinations used to simulate the firing or impact of ammunition.

13. The apparatus in accordance with claim 12 further comprising mounting means for mounting said control unit, said detonation generation means, and said pyrotechnic charges on a gun barrel of an armored vehicle.

* * * * *